United States Patent [19]

Schwartz

[11] Patent Number: 4,690,624

[45] Date of Patent: Sep. 1, 1987

[54] FUEL INJECTION PUMP FOR INTERNAL COMBUSTION ENGINES

[75] Inventor: Reinhard Schwartz, Stuttgart, Fed. Rep. of Germany

[73] Assignee: Robert Bosch GmbH, Stuttgart, Fed. Rep. of Germany

[21] Appl. No.: 886,454

[22] Filed: Jul. 17, 1986

[30] Foreign Application Priority Data

Oct. 8, 1985 [DE] Fed. Rep. of Germany ..... 3535808

[51] Int. Cl.[4] ..... F02M 59/26

[52] U.S. Cl. ..... 417/499; 417/490

[58] Field of Search ..... 417/490, 494, 499; 123/500, 503

[56] References Cited

U.S. PATENT DOCUMENTS 1,854,009 4/1932 Wilkinson ..... 123/500

2,296,357 9/1942 Links et al. ..... 417/494 X 3,963,384 6/1976 Bastenhof ..... 417/499

FOREIGN PATENT DOCUMENTS 0114205 8/1984 European Pat. Off. .

*Primary Examiner*—Leonard E. Smith

*Attorney, Agent, or Firm*—Edwin E. Greigg

[57] ABSTRACT

A fuel injection pump for internal combustion engines having a diversion bore disposed in the pump cylinder and controlled by a control edge on the pump piston. The diversion bore is embodied as a stepped bore having a segment of smaller diameter and a segment of larger diameter downstream of the segment in the flow direction. A liner which is not vulnerable to cavitation is disposed in the segment and is held in its working position by a resilient device, and a return flow conduit is formed between a chamber of lower pressure and an inlet to the bore of the liner.

18 Claims, 2 Drawing Figures

FUEL INJECTION PUMP FOR INTERNAL COMBUSTION ENGINES

BACKGROUND OF THE INVENTION

The invention is based on a fuel injection pump for internal combustion engines including an "anti-erosion device".

In a known fuel injection pump of this type (U.S. Pat. No. 3,963,384). a thin wall pointing substantially toward a control edge serves as an anti-erosion device, dividing a diversion bore into two conduits over virtually its entire length by use of a partition wall. This partition wall is intended to prevent damage to the wall of the diversion bore, because the fuel stream that emerges upon diversion then essentially strikes only the partition wall and thus spares the bore wall. This known device for preventing erosion damage in the diversion bore is very expensive to manufacture, without even actually preventing damage to the bore wall. Depending on how this partition wall is disposed, there is always a problem that the end of the wall oriented toward the pump piston should not have any adverse effect on the diversion stream, which could go so far as to present the risk of throttling this stream by interfering with its flow energy. The wall end must also be prevented from coming into contact with the pump piston; and the wall must be secured against axial displacement in this direction. Naturally a means of securing the wall in the opposite direction must also be provided, which means that an expensive securing means is required, which is for example provided in the prior art pump housing, which in turn, because of the radial arrangement with respect to the pump cylinder, causes problems in installing the pump. It has also been correctly realized that as much as possible, this wall should have no contact at all with the wall of the diversion bore; however, this makes for still more problems in installation.

In another known fuel injection pump (European patent application No. 0114205), although the pump is not of the same generic type, it is also an object to prevent erosion in the diversion bore. A return flow conduit is provided between the chamber into which the diversion bore discharges and at a point in the diversion bore at which the least outflow pressure prevails upon diversion of the injection. This location of the mouth of the return flow conduit in the diversion bore at the point whee the lowest flow pressure, or the highest flow velocity, prevails is remote from the inlet of the diversion bore, and erosion never occurs except downstream of this point. As is well known, the cause of this erosion is considered to be cavitation, that is, destruction of material at the bore wall, which is caused by the implosion of hollow spaces in the fuel. These hollow spaces in the fuel are in turn generated by negative-pressure waves, which can be generated by the relief valve of the pump and by the negative wave throwback at the injection nozzle. Naturally these problems exist primarily in pumps with high pumping capacities and high pressures. The control edge is usually provided on an oblique control groove that is present in the pump piston and communicates hydraulically, for instance via a central bore, with the pump work chamber, which is disposed upstream from the end of the pump piston. Taking into account these physical characteristics of pumps, further disadantages of the above-mentioned generic type of pump become apparent. The flow pressure is not at all increased by providing a wall of this kind; quite the contrary, there is only a throttling effect inside the diversion bore, which can cause increased bubble formation and also lowers the operating speed of the pump, especially if this diversion bore also serves as an intake line during the intake phase. The backpressure also then building up to an increased extent may cause after-injections at the injection nozzle, which worsens the engine emissions.

OBJECT AND SUMMARY OF THE INVENTION

The fuel injection pump according to the invention has the advantage over the prior art that the diversion bore inlet, which directly serves to effect diversion, can be manufactured very precisely in terms of location and dimensions, yet without this being affected by the anti-erosion device disposed downstream from it. The length of this shorter segment (that is, the diversion bore inlet) is arranged such that it terminates upstream of the point of lowest flow pressure, so that no cavitation can arise in this segment. A further advantage is that because of a liner, the flow cross section of the diversion conduit, now embodied by the first segment and the inner bore of the liner, can be enlarged in an intended manner. As a result of this enlargement, which may possibly be only slight, the flow profile is changed such that the flow pressure and the flow velocity are more uniform, over the entire length of the diversion conduit, and there are fewer differences in pressure and velocity. Not least, this provision according to the invention is very simple both in design and assembly, so that it can be realized at an extremely favorable cost.

According to an advantageous feature of the invention, the axial location of the liner is defined on one end by the shoulder face formed between the two segments of the diversion bore and on the other by a securing device secured to the pump cylinder and/or to the pump housing receiving the pump cylinder. In this way, it is very simple to install a liner of varying inside diameter as needed, given that the securing device must not exceed the outside diameter of the pump cylinder. In installing the pump, it is thus no longer necessary to be careful of other parts; instead, the pre-assembled pump cylinder is installed, including the liner and the securing device. A spring wire ring or spring sleeve, encompassing the pump cylinder, can be used as a securing device, by way of example; this enables easy installation and removal of the liner.

In another feature of the invention, a return flow conduit, which is located between the inner wall of the segment of the diversion bore having the larger diameter and the outer wall of the liner, effects communication via a radial segment between the chamber into which the diversion bore discharges and the interior of the diversion bore. In a manner known per se this brings about in the advantage that returing fuel lessens the negative pressure at the designated point, thereby making it possible to prevent cavitation. Naturally a number of smaller conduits may instead serve as the return flow conduit, being provided in one or both of the jacket faces that face one another. However, it is advantageous to dispose the return flow conduit in the form of one longitudinal groove in the inner wall of the diversion bore segment having the larger diameter, thereby avoiding weakening the liner as would happen if longitudinal grooves were used as a return flow conduit.

According to a further feature of the invention, this radial segment of the return flow conduit is embodied by a recess extending around the end face of the liner; this recess may be embodied either as an annular groove in the shoulder face or as radial openings at the appropriate end of the liner. This return flow conduit is most effective if its mouth is provided at the above-mentioned point of minimum flow pressure, or maximum flow velocity, in the diversion conduit. Thus, this point can be varied if need be by placing a ring of appropriate width, with an inside diameter corresponding to the diameter of the diversion bore segment having the smaller diameter, on the shoulder face first, and then having the above-mentioned liner adjoin this ring.

The invention will be better understood and further objects and advantages thereof will become more apparent from the ensuing dietailed description of a preferred embodiment taken from the drawing.

DESCRIPTION OF THE PREFERRED EMBODIMENT

Figure 1:
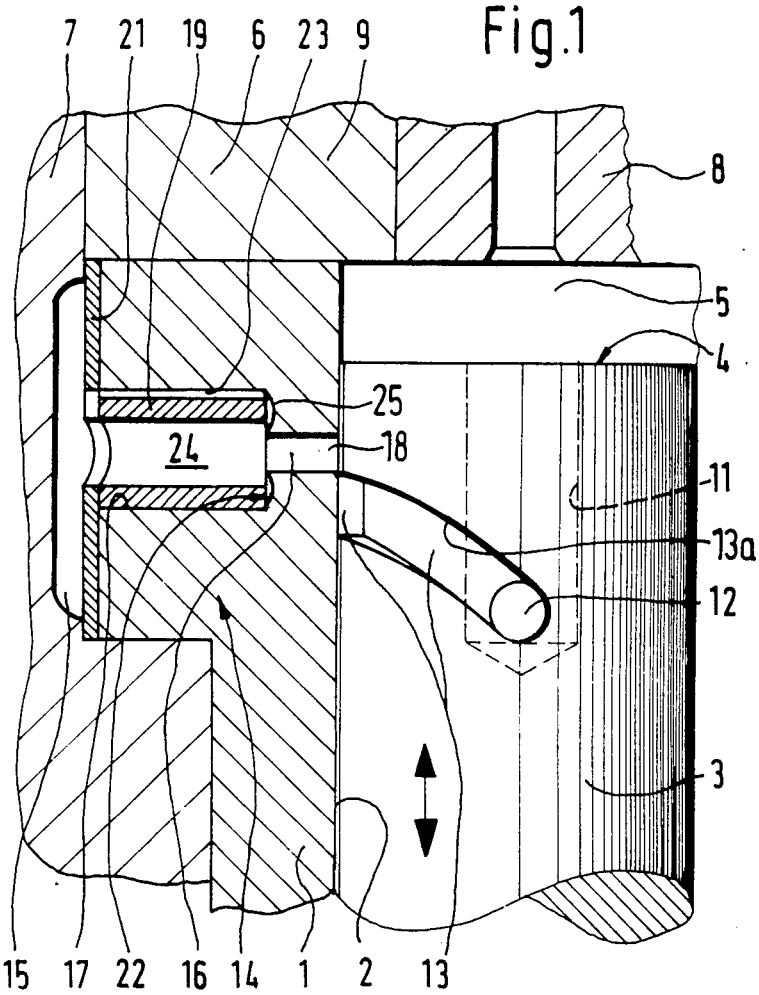
FIG. 1 is a longitudinal section taken through a detail, pertaining to the invention, of the injection pump.
Figure 2:
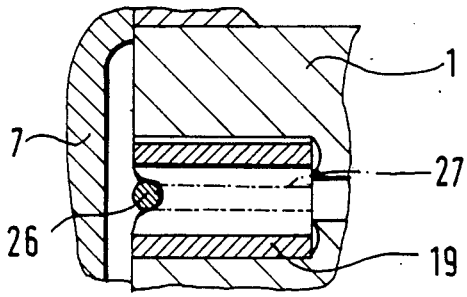
FIG. 2 shows a variant of the detail shown in the form of a detail of FIG. 1.

In FIGS. 1 and 2, the details of a fuel injection pump that are shown are those necessary to describe the invention. In a pump cylinder 1, a cylinder bore 2 is provided, in which a pump piston 3 is set into reciprocating motion by a cam drive, not shown, and with its upper end face 4 defines a pump work chamber 5. The pump cylinder 1 is fixed in a pump housing 7 via an element 6. The fuel positively displaced from the pump work chamber 5 by the pump piston 3 is pumped to the internal combustion engine via a pressure valve 8 and a pressure line, not shown.

This detail under discussion may for example be part of an in-line injection pump, in which case a corresponding number of pistons and pump cylinders are then disposed in rows beside one another. However, it may also belong to a one-cylinder injection pump.

A blind bore 11 is provided in the pump piston and via a radial bore 12 connects the pump work chamber 5 with an oblique groove 13 disposed on the piston jacket face. This oblique groove 13 cooperates with a diversion bore 14, which is disposed radially in the pump cylinder 1 and discharges into a fuel chamber 15 of lower pressure, which surrounds the pump cylinder 1 in segments and is enclosed by the housing 7. This diversion bore 14 has a segment 16 of smaller diameter and a segment 17 of larger diameter. The inlet 18 of the segment 16 having the smaller diameter cooperates with the oblique groove 13 for controlling fuel quantity. In the segment 17 of larger diameter there is a liner 19 which is made of a material not vulnerable to cavitation and is held by means of a spring sleeve 21, which wraps around the pump cylinder, on the stepped face 22 formed by the difference in diameter between the two segments 16 and 17. Between the liner 19 and the segment 17 having the larger diameter, a return flow conduit 23 is provided, which connects the chamber 15 with the inner bore 24 of the liner 19, and to this end a radial segment 25 is additionally provided, in the form of an annular end-face groove in the stepped face 22.

Depending on the rotational position of the pump piston 3, the oblique groove 13 is uncovered by the diversion bore 14 after another working stroke of the pump piston 3 has been executed; this happens because an oblique edge 13*a* comes to conicide with the inlet 18, after which the fuel, which until now has been pumped under pressure from the pump work chamber 5 to the engine, is now pumped via the blind bore 11, the radial bore 12, the oblique groove 12 and the diversion bore 14 to the chamber 15, the result of which is the end of the injection. In this diversion process, the fuel initially shoots at high pressure through the diversion bore segment 16 having the smaller diameter, whereupon the pressure decreases, and shortly after emerging from this segment 16 and entering the segment 17 of larger diameter, a low point of the flow pressure is attained, after which the flow pressure rises again up to the outlet of the bore 24 in the liner 19. By means of the fuel flowing out of the chamber 15 of lower pressure via the return flow conduit 23 and the radial segment 25 to this point where the flow pressure is at a minimum, this minimum level rises, so that it becomes possible to reduce the cavitation effect substantially.

Since the chamber 15 having the lower pressure is usually also the suction chamber of the injection pump, fuel flows out of this chamber 15 into the pump work chamber 5 during the intake stroke of the pump piston 3 and for as long as the oblique groove 13 continues to coincide with the inlet 18 of the diversion bore 14.

In the variant of this exemplary embodiment shown in FIG. 2, instead of a spring sleeve a spring ring 26 is used for radially fixing the liner 19; this sring ring 26 also wraps around the pump cylinder, to which end an annular groove 27 is machined into the jacket face of the pump cylinder. Otherwise, this variant functions in the same manner as that shown in FIG. 1.

The foregoing relates to preferred exemplary embodiments of the invention, it being understood that other variants and embodiments thereof are possible within the spirit and scope of the invention,the latter being defined by the appended claims.

What is claimed and desired to be secured by Letters Patent of the United States is:

1. A fuel injection pump for internal combustion engines having at least one pump cylinder, a fuel chamber, a diversion bore in said pump cylinder that extends to said fuel chamber, a pump piston that operates in said pump cylinder, said pump piston has a control edge cooperating with said diversion bore for an end of fuel supply, and a device in said diversion bore for preventing erosion, said diversion bore (14) is embodied as two segments, a stepped bore having a short, precisely disposed segment (16) of smaller diameter, and a longer segment (17) of larger diameter, said short segment (16) of smaller diameter forms a precisely embodied inlet (18) which cooperates with said control edge of said pump piston (3), said longer segment (17) of larger diameter includes therein said device (19) for preventing erosion, said device is formed by a liner (19) of erosion-resistant material having an inner bore (24) which has a diameter at least as large as that of said shorter segment (16) of said diversion bore (14).

2. A fuel injection pump as defined by claim 1, in which a transition from said segment (16) of smaller diameter ot the segment (17) of larger diameter of the diversion bore (14) is in the outflow direction upstream of the point of lowest flow pressure and highest flow velocity.

3. A fuel injection pump as defined by claim 1, in which an axial location of said liner (19) is defined on one end by a shoulder face (22) formed between said two segments (16 and 17) of said diversion bore (14) and on its opposite end by a securing device (21, 26).

4. A fuel injection pump as defined by claim 3, which includes a return flow conduit between an inner wall of said segment (17) of larger diameter of the diversion bore (14) and an outer wall of said liner (19), which via a radial segment (25) in said cylinder connects the fuel chamber (15) into which said diversion bore (14) discharges with an inlet end of said inner bore (24) of the liner (19).

5. A fuel injection pump as defined by claim 3, in whcih a transition from said segment (16) of smaller diameter to the segment (17) of larger diameter of the diversion bore (14) is in the outflow direction upstream of the point of lowest flow pressure and highest flow velocity.

6. A fuel injection pump as defined by claim 3 in which a spring wire ring (26) encircling said pump cylinder (1) serves as the securing device.

7. A fuel injection pump as defined by claim 6, which includes a return flow conduit between an inner wall of said segment (17) of larger diameter of the diversion bore (14) and an outer wall of said liner (19), which via a radial segment (25) in sai cylinder connects the fuel chamber (15) into which said diversion bore (14) discharges with an inlet end of said inner bore (24) of the liner (19).

8. A fuel injection pump as defined by claim 6, in which a transition from said segment (16) of smaller diameter to the segment (17) of larger diameter of the diversion bore (14) is in the outflow direction upstream of the point of lowest flow pressure and highest flow velocity.

9. A fuel injection pump as defined by claim 3, in which a spring sleeve (21) encircling the pump cylinder (1) serves as the securing device.

10. A fuel injection pump as defined by claim 9, which includes a return flow conduit between an inner wall of said segment (17) of larger diameter of the diversion bore (14) and an outer wall of said liner (19), which via a radial segment (25) in said cylinder connects the fuel chamber (15) into which said diversion bore (14) discharges with an inlet end of said inner bore (24) of the liner (19).

11. A fuel injection pump as defined by claim 9, in which a transition from said segment (16) of smaller diameter to the segment (17) of larger diameter of the diversion bore (14) is in the outflow direction upstream of the point of lowest flow pressure and highest flow velocity.

12. A fuel injection pump as defined by claim 1, which includes a return flow conduit between an inner wall of said segment (17) of larger diameter of the diversion bore (14) and an outer wall of said liner (19), which via a radial segment (25) in said cylinder connects the fuel chamber (15) into which said diversion bore (14) discharges with an inlet end of said inner bore (24) of the liner (19).

13. A fuel injection pump as defined by claim 12, in which a longitudinal groove (23) in the inner wall of the diversion bore segment (17) of larger diameter serves as said return flow conduit.

14. A fuel injection pump as defined by claim 12, in which a transition from said segment (16) of smaller diameter to the segment (17) of larger diameter of the diversion bore (14) is in the outflow direction upstream of the point of lowest flow pressure and highest flow velocity.

15. A fuel injection pump as defined by claim 12, in which said radial segment is formed by a recess which encompasses an end face of said liner (19).

16. A fuel injection pump as defined by claim 15, in which a longitudinal groove (23) in the inner wall of the diversion bore segment (17) of larger diameter serves as said return flow conduit.

17. A fuel injection pump as defined by claim 15, in which an annular end-face groove (25) in a stepped face (22) serves as said recess.

18. A fuel injection pump as defined by claim 17, in which a longitudinal groove (23) in the inner wall of the diversion bore segment (17) of larger diameter serves as said return flow conduit.

* * * * *